US005788405A

United States Patent [19]

Beard

[11] Patent Number: 5,788,405

[45] Date of Patent: Aug. 4, 1998

[54] VERTICAL HIGHWAY MARKER

[75] Inventor: James Richard Beard, New Ulm, Tex.

[73] Assignee: Lucy Caroline Beard, Austin, Tex.

[21] Appl. No.: 645,252

[22] Filed: May 13, 1996

[51] Int. Cl.[6] ..... E01F 9/00

[52] U.S. Cl. ..... 404/10; 404/9; 116/63 P; 40/608; 40/612; 248/160

[58] Field of Search ..... 409/9, 10; 40/606, 40/608, 612; 248/160, 548, 900; 116/63 P

[56] References Cited

U.S. PATENT DOCUMENTS

| | | | |
|---|---|---|---|
| 1,487,635 | 3/1924 | Watts | 40/608 |
| 1,755,443 | 4/1930 | Hartzler et al. | 404/10 |
| 3,478,715 | 11/1969 | Asbury | 404/10 |
| 3,913,518 | 10/1975 | Kaplan | 116/63 PC |
| 4,522,530 | 6/1985 | Arthur . | |
| 4,544,125 | 10/1985 | Seely | 248/624 |
| 4,564,309 | 1/1986 | Bjorlund . | |
| 4,691,892 | 9/1987 | Grewe et al. | 248/624 |
| 4,729,690 | 3/1988 | Lavender et al. . | |
| 4,751,893 | 6/1988 | Brantley | 116/63 R |
| 4,817,318 | 4/1989 | Strauch . | |
| 4,979,461 | 12/1990 | Provence, Jr. . | |
| 4,986,694 | 1/1991 | Delamere | 404/6 |
| 5,197,819 | 3/1993 | Hughes . | |
| 5,199,814 | 4/1993 | Clark et al. . | |
| 5,205,236 | 4/1993 | Hughes . | |
| 5,263,272 | 11/1993 | Fogelman . | |
| 5,277,146 | 1/1994 | Hughes, Jr. . | |
| 5,287,822 | 2/1994 | Anderson . | |
| 5,303,668 | 4/1994 | Huang . | |
| 5,315,777 | 5/1994 | Fogelman . | |
| 5,362,020 | 11/1994 | Brown . | |
| 5,446,984 | 9/1995 | Kulp et al. . | |
| 5,460,115 | 10/1995 | Speer et al. . | |

*Primary Examiner*—Tamara L. Graysay
*Assistant Examiner*—Gary S. Hartmann
*Attorney, Agent, or Firm*—Gregory M. Howison; Mark W. Handley

[57] ABSTRACT

A vertical highway marker is provided having a mounting base, a marker post and a mounting bracket. The mounting bracket secures the marker post to the mounting base. The highway marker includes a flexible region which bends so that the marker post will rotate relative to the mounting base when the marker post is impacted by a vehicle. The mounting base is a low-profile, square rubber pad which may be driven over by a vehicle without disturbing the driver's control of the vehicle. A resilient member is disposed proximate to the flexible region of the highway marker for bending with and stiffening the flexible region. Blocking members extend on forward and rearward sides of the resilient member and the flexible region for limiting a range of bending over which the resilient member bends with the flexible region, such that the stresses within the resilient member are not substantially greater than the yield strength of the resilient member. In a preferred embodiment, two strips of the elastomeric belting are used to provide the forward and rearward blocking members. The blocking members are secured on one end to the mounting base and have opposite ends which extend upward on the forward and rearward sides of the marker post.

11 Claims, 4 Drawing Sheets

VERTICAL HIGHWAY MARKER

TECHNICAL FIELD OF THE INVENTION

The present invention relates in general to highway markers for displaying traffic markings along roadways, and in particular, to a vertical highway marker which is flexible and can sustain multiple impacts from fast moving vehicles without deterioration.

BACKGROUND OF THE INVENTION

Prior art highway markers have been utilized to provide traffic markings along roadways. Some prior art highway markers are rigid so that they are destroyed when struck by on-coming vehicles. Other prior art highway markers are flexible so that they will bend when run over by vehicles. One type of prior art highway marker includes a marker post secured to a mounting base by a piece of flexible tubing. When struck by an on-coming car, the flexible tubing will bend and allow the marker post to lie flat on the ground. However, the flexible tubing used to connect the marker post to the mounting base cannot sustain the impacts of fast moving vehicles without significant deterioration. The flexible tubing will either be destroyed or permanently bent when struck by vehicles traveling at speeds of 60 m.p.h. Some current government highway regulations require that vertical highway marker be within five (5) degrees of vertical to be acceptable.

Other types of prior art highway markers have included flexible marker posts which are bolted to flat mounting bases. The flat mounting bases may be formed of rubber pads. Some prior art highway markers have been bolted to the mounting bases with flanges made of angle iron. Other highway markers have been secured to mounting bases by flexible springs which are mounted to balls fitting within sockets of the mounting bases. These types of highway markers can not sustain the impacts of fast moving vehicles without being destroyed.

Some prior art vertical highway markers have been provided with flexible marker posts formed of rubber strips, such as from used tires, which are joined together with an adhesive. The flexible marker posts are typically bolted to mounting bases with metal flanges, such as angle iron. When run over by a fast moving vehicle the flange can puncture the tires of the vehicle and cause loss of control of the vehicle. A safer vertical highway marker is desired.

SUMMARY OF THE INVENTION

A vertical highway marker is provided having a mounting base, a marker post and a mounting bracket. The mounting bracket secures the marker post to the mounting base. The highway marker includes a flexible region which bends so that the marker post will rotate relative to the mounting base when the marker post is impacted by a vehicle. The mounting base is a low-profile, square rubber pad which may be driven over by a vehicle without disturbing the driver's control of the vehicle. A resilient member is disposed proximate to the flexible region of the highway marker for bending with and stiffening the flexible region. Blocking members extend on forward and rearward sides of the resilient member and the flexible region for limiting a range of bending over which the resilient member bends with the flexible region, such that the stresses within the resilient member are not substantially greater than the yield strength of the resilient member. In a preferred embodiment, two strips of the elastomeric belting are used to provide the forward and rearward blocking members. The blocking members are secured on one end to the mounting base and have opposite ends which extend upward on the forward and rearward sides of the marker post.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
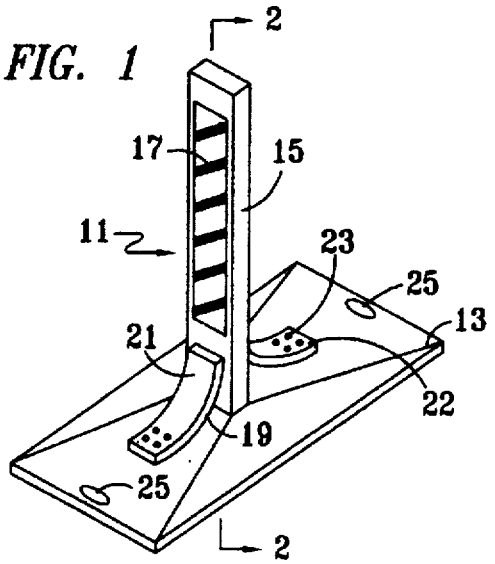
FIG. 1 is a perspective view illustrating a vertical highway marker made according to the present invention.

FIG. 1 is a perspective view illustrating highway marker 11 of a preferred embodiment of the present invention. Highway marker 11 includes mounting base 13 which is a low-profile, molded, rubber mounting base. Preferably, mounting base 13 measures approximately 24" wide, 28" long, ½" thick (vertical height) at the outer peripheral edges, and 2" thick (vertical height) at the center. Marker post 15 preferably extends vertically upward from mounting base 13 and includes traffic markings 17. Mounting bracket 19 secures marker post 15 to mounting base 13. Strips 21, 22 of rubber belting provide elastomeric blocking members. Bolts 23 secure rubber belting strips 21, 22 to mounting base 13. Lifting holes 25 are provided on the opposite, longitudinal ends of mounting base 13.

Figure 2:
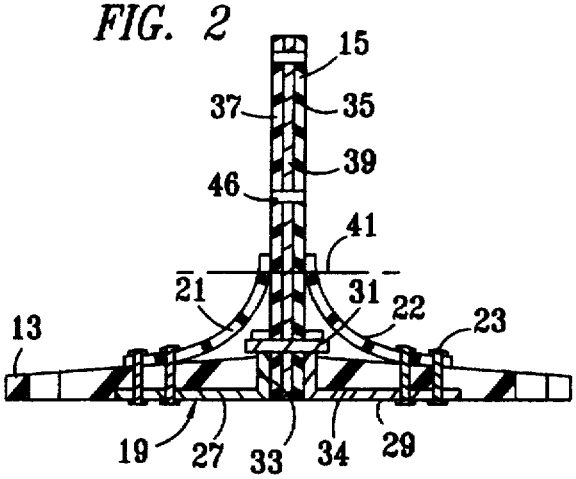
FIG. 2 is a vertical section view illustrating the vertical highway marker of FIG. 1, taken along section line 2—2.

FIG. 2 is a sectional view of highway marker 11, taken along section line 2—2 of FIG. 1. Mounting bracket 19 includes angle iron 27 and angle iron 29. Mounting bolt 31 extends through a lower, inward end of marker post 15 and the spaced apart, upwardly extending ears of angle iron 27, 29. Angle iron 27, 29 is also bolted to rubber mounting base 13 by bolts 23.

Vertical hole 33 extends downward into molded rubber mounting base 13. Lower cavity 34 extends into the lowermost surface of mounting base 13. Marker post 15 extends through vertical hole 33 and into lower cavity 34. Mounting bracket 19 extends upward from within lower cavity 34 and through vertical hole 33. The lowermost surface of mounting bracket 19 preferably fits flush with the lowermost surface of mounting base 13.

Marker post 15 comprises rubber strip 35 and rubber strip 37 which are both adhesively bonded to strip of spring steel 39. In other embodiments of the present invention, rubber strips 35, 37 and spring steel 39 may be provided by two strips of tires, having steel belting, which are glued together. A center line 41 is shown for an optional bolt center line. However, in the preferred embodiment, the upper ends of strips 21, 22 are neither bonded nor bolted to marker post 15.

Figure 3:
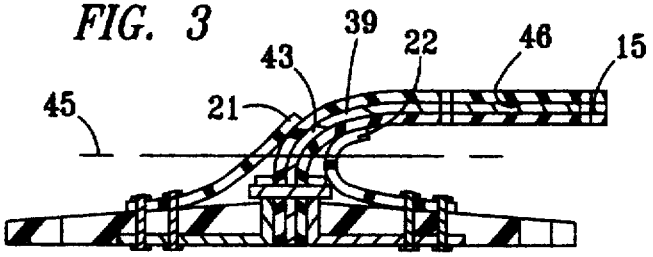
FIG. 3 is a vertical section view illustrating the vertical highway marker of FIG. 1, taken along the same sectioning plane as FIG. 2 and depicting the vertical highway marker being bent when impacted by a vehicle.

FIG. 3 depicts highway marker 11 of FIGS. 1 and 2, and is a sectional view taken along the vertical sectioning plane of FIG. 2. Marker post 15 is depicted as bending in flexible region 43 about center line 45. The outer end of marker post 15 has been bent downward, rotating clockwise around the lower end of marker post 15 so that the outer end of marker post 15 extends parallel to the ground. A vehicle may impact and then run over marker post 15 without either destroying or substantially deteriorating marker post 15.

FIGS. 2 and 3 depict mounting holes 46 which may be used for mounting a sign to marker post 15, rather than using a reflective strip such as traffic markings 17 of FIG. 1. If a panel or plate type of sign is mounted to marker post 15, it should not affect the ability of highway marker 11 to withstand the impacts of fast moving vehicles without substantial deterioration.

In operation, strips of rubber belting 21, 22 provide elastomeric blocking members so that spring steel strip 39 within marker post 15 is not bent beyond a radius of curvature at which the mechanical stresses in strip 39 would exceed the yield strength of the string steel. Typically, for most spring steels, a radius of curvature of ninety (90) degrees must be avoided in order to prevent spring steel 39 from crimping. Crimping occurs when the material within spring steel is mechanically stressed to stresses which are above the yield strength for the spring steel material. Permanent plastic deformation of such materials usually occurs above a range of stresses at which mechanical stresses within the members substantially exceed a lower value of the yield strength range at which both plastic and elastic deformation of the materials occurs.

Figure 4:
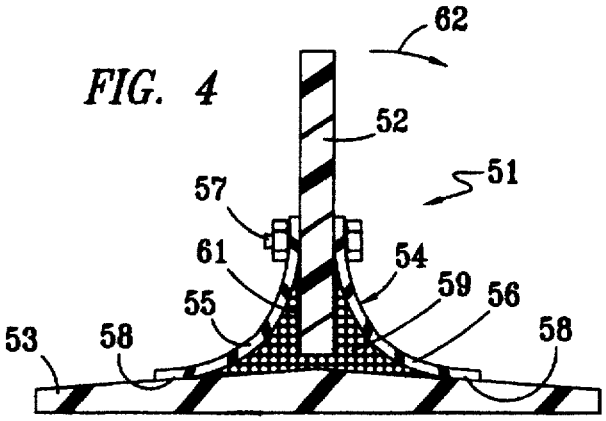
FIG. 4 is a vertical section view illustrating a vertical highway marker of a first alternative embodiment of the present invention.

FIG. 4 is a sectional view illustrating alternative highway marker 51, taken along an elevational sectioning plane similar to that of FIG. 2. Alternative highway marker 51 includes marker post 52 which may be formed of a rigid material such as steel, a plastic, or of a flexible material, such as rubber. Marker post 52 is shown as being formed of plastic. Highway marker 51 includes rubber mounting base 53, which is preferably a low-profile, molded, rubber, mounting base similar to mounting base 13 of FIG. 1.

Mounting bracket 54 secures mounting marker post 52 to rubber mounting base 53. Mounting bracket 54 includes elastomeric strips 55, 56 which are adhesively bonded to the surface of rubber mounting base 53 at mounting regions 58. Elastomeric strips 55, 56 are preferably formed from strips of rubber, such as tires or conveyor belting. The tires or the conveyor belting may be steel reinforced. Mounting bolt 57 extends through the upper ends of elastomeric strips 55, 56 and the lower, inward end of marker post 52 to mount marker post 52 to rubber mounting base 53. Pliable material 59 is resilient mass of elastomeric materials, preferably provided by adhesively bonded crumb rubber which fills an interior space between elastomeric strips 55, 56. Flexible region 61 of alternative highway marker 51 is defined by crumb rubber 59 and elastomeric strips 55, 56. Flexible region 61 flexes, or bends, to rotate maker post 52 when the upper end of marker post 52 is moved in direction 62. Elastomeric strips 55, 56 provide resilient blocking members which allow marker post 52 to angularly displace relative to mounting base 53 and which prevent excessive bending of flexible region 61.

Figure 5:
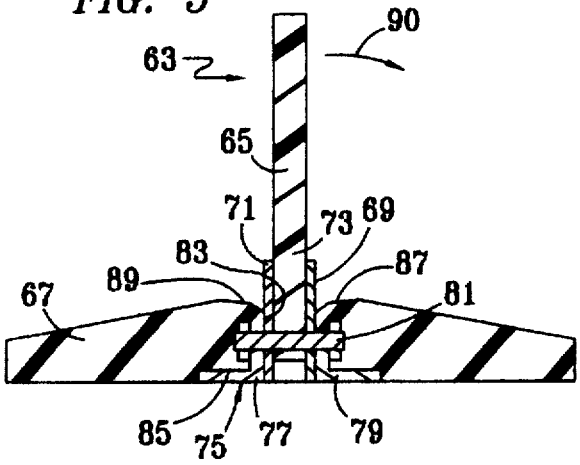
FIG. 5 is a vertical section view illustrating a vertical highway marker of a second alternative embodiment of the present invention.

FIG. 5 is a sectional view of alternative highway marker 63, taken along a vertical sectioning plane. Alternative highway marker 63 includes marker post 65 and molded rubber mounting base 67. Molded rubber mounting base 67 preferably has a low-profile, having dimensions which are similar to that of mounting base 13 of FIG. 1. Strips of spring steel 69, 71 extend on forward and rearward sides of marker post 65, respectively. Marker post 65 is depicted as being formed of plastic. Preferably, marker post 65 is formed of a flexible material. Flexible region 73 is provided at a lower, inward end of marker post 65, between the strips of spring steel 69, 71.

Mounting bracket 75 secures marker post 65 and strips of spring steel 69, 71 to mounting base 67. Mounting bracket 75 is provided by angle iron piece 77 and angle iron piece 79. Mounting bolt 81 extends through the upwardly disposed ears of angle iron 77, 79 to secure strips of spring steel 69, 71 and marker post 65 in the gap between the spaced apart upward ears of angle iron 77, 79. Vertical hole 83 extends downward through a central portion of rubber mounting base 67 and into a lower cavity 85. Vertical hole 83 and lower cavity 85 are provided so that mounting bracket 75 may be secured within mounting base 67. Mounting bracket 75 may optionally be adhesively bonded or bolted within mounting base 67.

Rubber mounting base 67 is molded so that it includes protuberances 87, 89 which extend forward and rearward of strips of spring steel 69, 71 and the lower, inward end of marker post 65. Protuberances 87, 89 have rounded, arcuate surfaces which provide blocking members so that when marker post 65 is impacted by a vehicle and caused to rotate in direction 90, flexible region 73 and strips of spring steel 69, 71 will not bend past a minimum radius of curvature defined by protuberances 87, 89. Protuberances 87, 89 prevent strips of spring steel 69, 71 from being bent beyond a minimum radius of curvature to prevent the strips 69, 71 from crimping, that is to prevent strips 69, 71 from being stressed beyond the yield strength of the materials from which they are formed.

Figure 6:
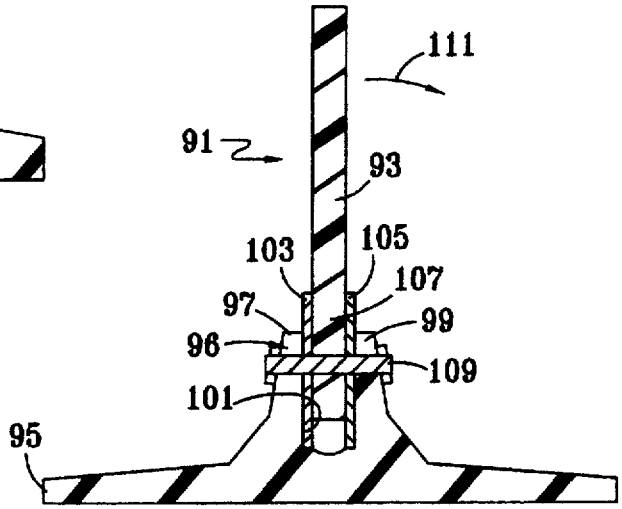
FIG. 6 is a vertical section view illustrating a vertical highway marker of a third alternative embodiment of the present invention.

FIG. 6 is a sectional view depicting alternative highway marker 91 of the present invention. Alternative highway marker 91 includes marker post 93 and rubber mounting base 95. Rubber mounting base 95 includes an integrally formed, molded rubber mounting bracket 96. Preferably, rubber mounting base 95 is a molded rubber piece having a low-profile, similar to mounting base 13 of FIG. 1. Mounting bracket 96 includes ears 97, 99 which provide tabs for mounting marker post 93 to mounting base 95. Ears 97, 99 also provide blocking members. Slot 101 is defined by the gap between spaced apart ears 97, 99. Strips of spring steel 103, 105 are mounted between ears 97, 99 on the forward and rearward sides of marker post 93, respectively. Flexible region 107 is defined by strips of spring steel 103, 105 and marker post 93. Through bolt 109 extends through ears 97, 99 to secure marker post 93 within mounting bracket 96. A vehicle impacting against an outward end of marker post 93 will cause marker post 93 to rotate in direction 111. Ears 97, 99 will provide blocking members to prevent strips of spring steel 103, 105 from bending beyond a minimum radius of curvature, such that stresses within strips 103, 105 will not exceed the yield strength of the material from which they are made.

Figure 7:
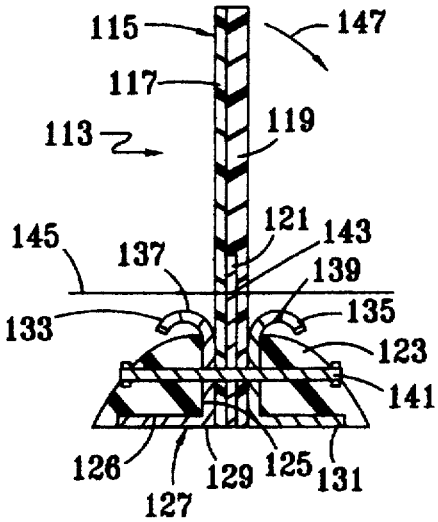
FIG. 7 is a vertical section view illustrating a vertical marker of a fourth alternative embodiment of the present invention.

FIG. 7 is an elevation section view of alternative highway marker 113 of the present invention. Alternative highway marker 113 includes marker post 115, which is preferably formed of two plastic sheets, or strips, 117, 119 that are bonded together with an adhesive. An inward, lower end of marker post 115 includes spring steel strip 121 which is adhesively bonded between plastic strips 117, 119. Alternative highway marker 113 further includes mounting base 123, which is preferably formed of a molded rubber. Mounting base 123 is of the type for adhesively bonding to a roadway surface. Vertical hole 125 extends downward through the center of mounting base 123 to a lower cavity 126. Mounting bracket 127 extends within lower cavity 126 and upward through vertical hole 125, with the lower most end of mounting bracket 127 preferably being flush with the lower most end of mounting base 123.

Mounting bracket 127 includes angle iron 129 and angle iron 131. The upper most ends of angle iron 129, 131 provide tabs 133, 135, respectively, having curved profiles 137, 139, respectively. Through bolt 141 extends through tabs 133, 135 and marker post 115 to secure marker post 115 to mounting bracket 127 and mounting base 123. Flexible region 143 is defined in the inward, lower end of marker post 115 and the upper portion of spring steel strip 121, so that marker post 115 will bend in direction 147 about center line 145 when impacted on the forward end by a vehicle. Curved profiles 137, 139 are provided by the upper most surfaces of tabs 133, 135 of the angle iron 129, 131, respectively. Curved profiles 137, 139 provide blocking members which determine a minimum radius of curvature for spring steel strip 127. The shape of curved profiles 137, 139 is determined so that the mechanical stresses within spring steel strip 127 will not exceed the yield strength of the material from which strip 121 is made when spring steel strip 121 is bent to the minimum radius of curvature.

Figure 8:
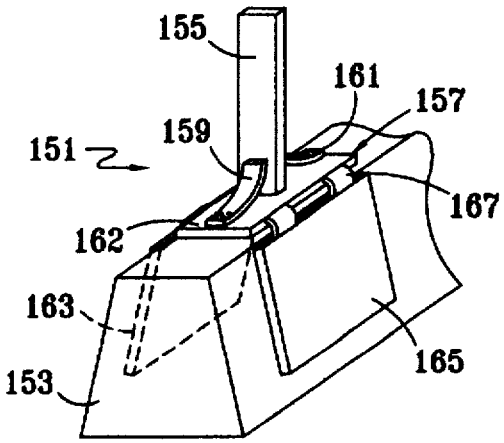
FIG. 8 is a perspective view illustrating a vertical highway marker of a fifth alternative embodiment of the present invention mounted to a concrete median.

FIG. 8 is a perspective view of alternative highway marker 151, mounted atop concrete median 153. Alternative highway marker 151 includes marker post 155 and mounting base 157. Marker post 155 may be mounted to mounting base 157 by a mounting bracket, such as those of the present invention. Preferably, marker post 155 is mounted to mounting base 157 by strips of rubber conveyor belting 159, 161, similar to that for highway marker 11 depicted in FIGS. 1 through 3.

Mounting base 157 further includes mounting platform 162 and side panels 163, 165 which extend downward from mounting base 157 so that they fit flush against the angled sides of concrete median 153 when the lower most surface of mounting platform 162 is sitting flush atop the top surface of concrete median 153. Four connecting brackets 167 connect side panels 163, 165 to mounting base 157. Preferably, mounting base 157, including side panels 163 and 165, is formed of molded rubber. In other embodiments, side panel 163, 165 and the central mounting platform 162 of mounting base 157 may be formed of a singular piece of molded rubber having a U-shaped channel for receiving the sides and top of a concrete median such as concrete median 153 of FIG. 8.

Figure 9:
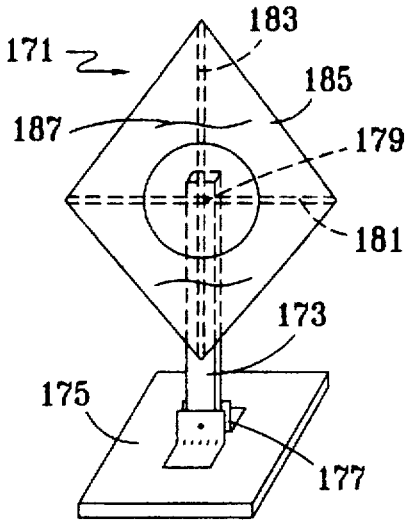
FIG. 9 is a perspective view of a vertical highway marker of a sixth alternative embodiment of the present invention having a traffic sign for reducing windage loads.

FIG. 9 is a perspective view of alternative highway marker 171 of the present invention. Highway marker 171 includes marker post 173 which is attached to rubber mounting base 175 by mounting bracket 177. Mounting bracket 177 is preferably made according to the embodiment of FIGS. 1 through 3. Vertical highway marker 171 further includes frame 179 having ribs 181, 183. Ribs 181 and 183 provide cross braces for mounting a mesh, nylon fabric 185 having traffic markings 187. Mesh nylon fabric 185 is a woven fabric which provides air gaps between the fibers from which it is woven in order to reduce the windage forces caused by high winds blowing against vertical highway marker 171. Although traffic markings 187 are provided on mesh fabric 185, the fabric 185 may be provided so that it is somewhat transparent.

Figure 10:
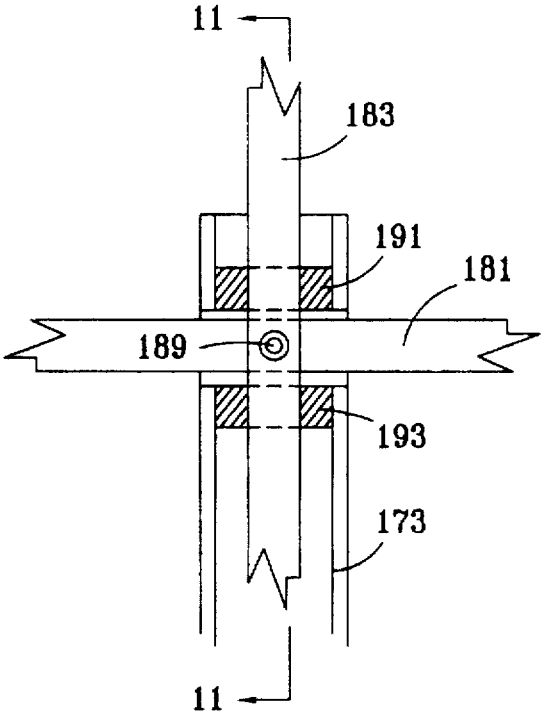
FIG. 10 is a partial cutaway view showing a support assembly of the vertical highway marker of FIG. 9.

FIG. 10 is a partial cutaway view of vertical highway marker 171, as would be seen when looking at the front of the marker with the mesh nylon fabric 185 removed. Through bolt 189 secures ribs 181 and 183 to marker post 173. Top lock block 191 and bottom lock block 193 extend above and below horizontal rib 181, respectively, and prevent rib 181 from rotating under windage loads. Lock blocks 191, 193 also each provide, on opposite sides, frictional engagement surfaces so that vertical rib 183 will not move relative to marker post 173.

Figure 11:
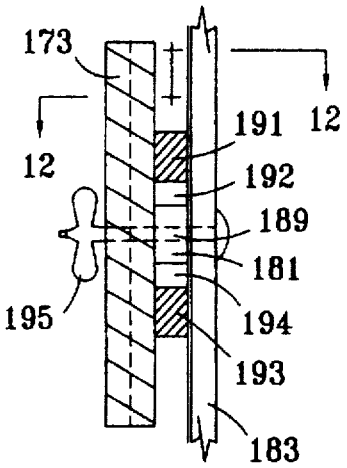
FIG. 11 is a partial section view of the vertical highway marker of FIG. 9, taken along section line 11—11 of FIG. 10.

FIG. 11 is a partial section view of vertical highway marker 171 taken along section line 11—11 of FIG. 10. Lock blocks 191, 193 are depicted extending between vertically extending rib 183 and marker post 173. Wing nut 195 is provided for threadingly engaging through bolt 189 to draw rib 183 towards marker post 173 and squeeze lock blocks 191 and 193 therebetween. Lock blocks 191, 193 also preferably have horizontally extending tapered surfaces 192, 194, with taper 192 facing towards taper 194.

Figure 12:
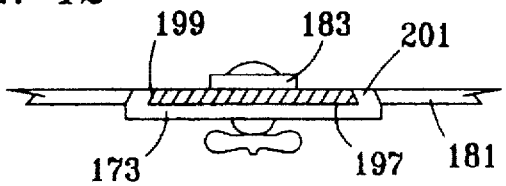
FIG. 12 is a partial section view of the vertical highway marker of FIG. 9, taken along section line 12—12 of FIG. 11.

FIG. 12 is a partial section view of vertical highway marker 171 of FIG. 11, taken along section line 12—12. Marker post 173 is preferably formed of a channel type frame member, having channel 197 which extends longitudinally along marker post 173 in a vertical direction. Channel 197 has edge lips 199, 201. Lips 199, 201 are preferably removed in a central, horizontally extending region for passing horizontally extending rib 183.

Figure 13:
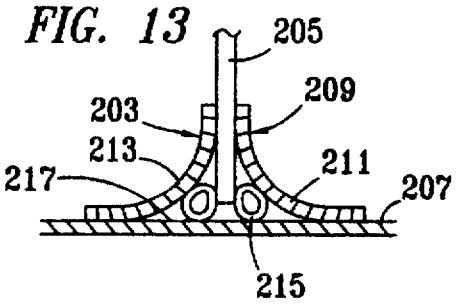
FIG. 13 is a vertical section view illustrating a vertical highway marker of a seventh alternative embodiment of the present invention.

FIG. 13 is a vertical section, elevational view depicting alternative highway marker 203. Marker 203 includes marker post 205 and mounting base 207. Marker post 205 may be formed of flexible or rigid material. Mounting base 207 is preferably formed of a molded rubber pad type of mounting base having a low profile, such as that described above for mounting base 13 of FIG. 1. Mounting bracket 209 secures marker post 205 to mounting base 207. Mounting bracket 209 includes side members 211, 213, which are preferably formed of conveyor belting to provide a resilient, rubber type of hinge which is flexible. Side members 211, 213 are secured to mounting base 207. The upper ends of side flaps 211, 213 are preferably secured to marker post 205. A mechanical fastener or an adhesive may be used to secure flaps 211, 213 and marker post 205.

Tubular resilient member 215 extends around the base of marker post 205 in the annular space 217 disposed between the base of marker post 205 and the interior of side members 211, 213. The length of tubular member 215 preferably extends completely around the lower end of marker post 205, in a horizontal plane. Resilient tubular member 215 may be formed of rubber hose or plastic tubing which is squeezed as the marker post 215 is bent from a vertical to a horizontal position, and which will later spring back to urge marker post 205 to return to a vertical position. Side members 211, 213 provide blocking members and a flexible portion of alternative highway marker 203 which will bend to allow marker post 205 to move between vertical and horizontal positions. Additionally, annular space 217 may optionally be filled with a pliable material such as crumb rubber.

Figure 14:
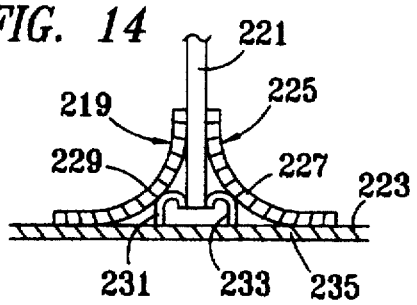
FIG. 14 is a vertical section view illustrating a vertical highway marker of an eighth alternative embodiment of the present invention.

FIG. 14 is a side elevational section view of alternative highway marker 219. Alternative vertical highway marker 219 includes marker post 221 and mounting base 223. Marker post 221 may be formed of flexible or rigid material. Mounting base 223 is preferably a low profile type of mounting base, such as that disclosed for mounting base 13 of FIG. 1. Mounting bracket 225 secures marker post 221 to mounting base 223. Mounting bracket 225 includes side members 227, 229. Side members 227, 229 are secured to mounting base 223 either by an adhesive or by a mechanical fastener (not shown). The upper ends of side members 227, 229 are preferably secured to the lower end of marker post 221.

Resilient members 231, 233, are secured to the lower, base end of marker post 221 and to mounting base 223, between the lower end of marker post 221 and side members 227, 229. When marker post 221 is urged from a vertical position toward a horizontal position, resilient members 231, 233 will deform to allow the lower end of the marker post 221 to move. Mounting bracket 225 flexes and bends as vertical marker post 221 is moved from a vertical position toward a horizontal position. Resilient members 231, 233 are preferably formed of rubber so that they will deform to allow mounting bracket 225 to bend and flex, and then spring back to move marker post 221 back to a vertical position. Annular space 235 extends between side members 227, 229 and marker post 221, and above mounting base 223. Annular space 235 may optionally be filled with a pliable material, such as crumb rubber.

Figure 15:
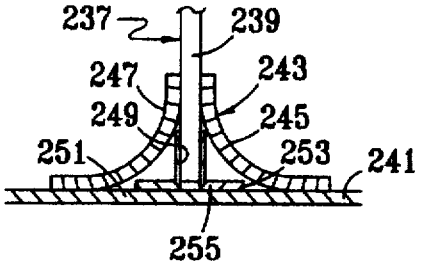
FIG. 15 is a vertical section view illustrating a vertical highway marker of a ninth alternative embodiment of the present invention.

FIG. 15 is a side elevational section view of alternative vertical highway marker 237. Alternative vertical highway marker 237 includes marker post 239 and mounting base 241. Marker post 239 may be either flexible or rigid. Mounting base 241 is preferably formed of a molded rubber mounting base having a low profile similar to that of mounting base 13 of FIG. 1. Mounting bracket 243 secures marker post 239 to mounting base 241. Mounting bracket 243 is flexible so that when the outward end of marker post 239 is impacted by a vehicle, it will rotate relative to mounting base 241. Mounting bracket 243 includes side members 245 and 247, which provide blocking members. The lower, base end of marker post 239 extends in channel 249, which is defined between resilient brackets 251, 253. Resilient brackets 251, 253 are each preferably formed of either spring steel or plastic, and are depicted in FIG. 5 as extending with two sides at right angles. Annular space 255 is defined between the base end of marker post 239 and side members 245, 247, and above mounting base 243. Annular space 255 may optionally be filled with a pliable material, such as crumb rubber.

Figure 16:
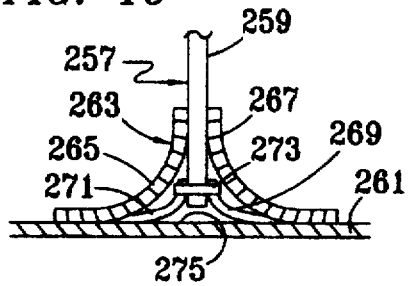
FIG. 16 is a vertical section view illustrating a vertical highway marker of a tenth alternative embodiment of the present invention.

FIG. 16 is a side elevational section view depicting alternative vertical highway marker 257, taken along a vertical sectioning plane. Alternative vertical highway marker 257 includes marker post 259 and mounting base 261. Marker post 259 may be either flexible or rigid. Mounting base 261 is preferably of the type having a low profile and formed of a molded rubber, such as mounting base 13 of FIG. 1. Mounting bracket 263 is flexible and secures marker post 259 to mounting base 261 such that marker post 259 may be deflected and bent relative to mounting base 261 when impacted by a vehicle. Mounting bracket 263 includes side members 265, 267.

Resilient bands 269, 271 are secured to the lower, base end of marker post 259 by mounting bolt 273. Resilient bands 269, 271 preferably extend forward and rearward, respectively, at the lower, base end of marker post 259 and are secured on the outward, terminal ends to mounting base 261. Resilient bands 269, 271 are preferably formed of rubber or another type of elastomeric material. Resilient bands 269, 271 should be formed so that they will exert enough force to urge marker post 259 into a vertical position and maintain marker post 259 in a substantially vertical position until impacted by a vehicle. Resilient bands 269, 271 should also be formed and mounted such that they extend for a sufficient distance outward from the lower, base end of marker post 259 so that they can stretch, without yielding, to allow marker post 259 to be moved to a substantially horizontal position when impacted by a vehicle. Annular space 275 extends between the lower, base end of marker post 259 and side members 265, 267, and above mounting base 261. Annular space 275 may optionally be filled with a pliable material, such as crumb rubber.

Figure 17:
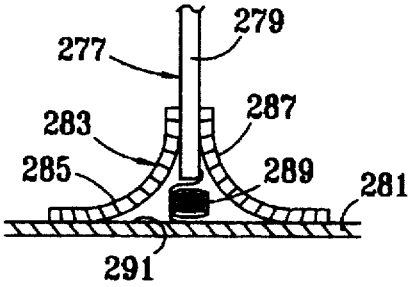
FIG. 17 is a vertical section view illustrating a vertical highway marker of an eleventh alternative embodiment of the present invention.

FIG. 17 is a side elevational section view depicting alternative vertical highway marker 277 of the present invention. Alternative vertical highway marker 277 includes marker post 279 which extends vertically upward above mounting base 281. Marker post 279 may be flexible or rigid. Mounting bracket 283 secures marker post 279 to mounting base 281, and is flexible so that marker post 279 may be angularly displaced relative to mounting base 281. Side members 285, 287 are secured to mounting base 281 and extend upward about marker post 279. Side members 285, 287 are preferably secured to marker post 279 by either an adhesive, as shown, or a mounting bolt.

Coil spring 289 provides a resilient member which secures the lower, base end of marker post 279 to mounting base 281. In other embodiments, a solid tubular resilient member formed of elastomeric material, such as a rubber or other type of flexible, resilient member may be used in place of coiled spring 289. Coiled spring 289 is resilient member being flexible enough so that when alternative vertical highway marker 277 is hit by an oncoming vehicle, it will allow marker post 279 to bend downward to a horizontal position, substantially parallel to mounting base 281. Coiled spring 289 will then return marker post 279 to an upright, vertical position after the vehicle has run completely over alternative highway marker 277. Annular space 291 is defined to extend between side members 285, 287 and marker post 279, above mounting base 281. Annular space 291 may be filled with a pliable material, such as crumb rubber.

Figure 18:
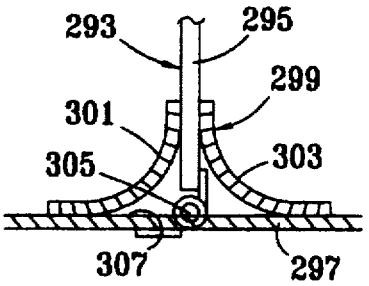
FIG. 18 is a vertical section view illustrating a vertical highway marker of a twelfth alternative embodiment of the present invention.

FIG. 18 is a side elevational section view depicting alternative vertical highway marker 293. Alternative vertical highway marker 293 includes marker post 295 and mounting base 297. Marker post 295 may be either flexible or rigid, and is secured to mounting base 297 by mounting bracket 299 so that it will extend vertically above mounting base 297. Mounting base 297 is preferably a molded rubber mounting base having a low profile, similar to mounting base 13 of FIG. 1. Mounting bracket 299 is flexible so that it will bend to allow marker post 295 to bend downward relative to mounting base 297. Mounting bracket 299 includes side members 301, 303 which are optional in this embodiment of the present invention.

Spring biased hinge 305 extends for securing the lower, base end of marker post 295 to mounting base 297. As depicted in FIG. 18, spring biased hinge 305 extends with a longitudinal length which is perpendicular to the sectioning plane of FIG. 18. Spring biased hinge 305 is constructed similar to a piano type of hinge. Annular space 307 extends between side members 301, 303 and above mounting base 297. Annular space 307 may be filled with a pliable material, such as crumb rubber.

Figure 19:
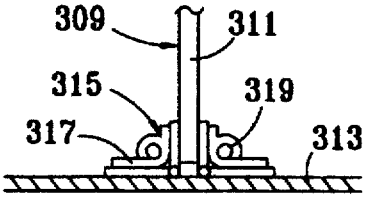
FIG. 19 is a vertical section view illustrating a vertical marker of a thirteenth alternative embodiment of the present invention.

FIG. 19 is a side elevational section view depicting alternative vertical highway marker 309. Vertical highway marker 309 includes marker post 311 and mounting base 313. Flexible mounting bracket 315 is provided for securing marker post 311 to mounting base 313. Mounting bracket 315 is flexible so that it may bend 5 to allow marker post 311 to deflect relative to mounting base 313. Marker post 311 may be either rigid or flexible. Mounting base 313 is preferably formed of a molded rubber and has a low profile, similar to mounting base 13 of FIG. 1. Mounting bracket 315 includes spring biased hinges 317, 319. Spring biased hinges 317, 319 are disposed forward and rearward, respectively, of the lower, base end of marker post 311. The axes around which respective ones of hinges 317, 319 bend extend perpendicular to the sectioning plane of FIG. 19. Spring biased hinges 317, 319, may also be constructed similar to piano hinges.

It should also be noted that in various ones of the above-referenced embodiments, separate side blocking members of a particular embodiment may be formed of a single, continuously extending member, such as a frustrum shaped sleeve which extends completely around the inward, or lower, end of a mounting base rather than being formed of two separate members. Marker posts of highway markers of the present invention may be formed of flat panels rather than actual posts, such as an actual sign panel.

The present invention has several advantages over prior art vertical highway markers. A vertical highway marker made according to the present invention can sustain impacts of fast moving vehicles without substantial deterioration. Vertical highway markers made according to the present invention have sustained multiple impacts by vehicles moving in excess of sixty (60) miles per hour without appreciable deterioration of the ability of the marker to return to within five (5) degrees of a vertical position after each of the impacts. Flexible highway markers made according to the present invention preferably have a spring steel member which provides a resilient member for returning the marker post to a vertical position. Marker posts made according to the present invention typically include a blocking member to prevent the spring steel from bending beyond a minimum radius of curvature so that the stresses within the spring steel will not exceed the yield strength of the steel.

Highway markers made according to the present invention may include a mounting base which has adjacent surfaces which are configured for fitting flush atop a concrete barrier, such as a highway median. Highway markers made according to the present invention may also include a support frame to which is mounted a mesh fabric having traffic markings. The mesh fabric being of woven fabrics having a weave such that air gaps are provided to reduce windage forces which would tend to bend over flexible traffic markers in high winds. Additionally, highway markers of the present invention preferably have low-profile mounting bases formed of molded rubber pieces so that a fast moving vehicle may run over the mounting bases without the driver losing control of the vehicle.

Although embodiments of the invention have been described in detail, it should be understood that various changes, substitutions and alterations can be made therein without departing from the spirit and scope of the invention as defined by the appended claims.

What is claimed is:

1. In a highway marker of the type having a mounting base, a marker post and a mounting bracket securing the marker post to the mounting base, one of the mounting base, the marker post and the mounting bracket being flexible for bending in a flexible region to rotate the marker post relative to the mounting base in response to forces acting on an outward end of the marker post, the improvement comprising:

a resilient member disposed proximate to the flexible region for bending with and stiffening the flexible region of the one of the mounting base, the marker post and the mounting bracket which is flexible and bends in response to the forces;

a blocking member extending on at least a rearward side of the resilient member for limiting a range of bending over which the resilient member bends with the flexible region of the one of the mounting base, the marker post and the mounting bracket;

wherein the blocking member limits the range of bending of the resilient member to determine a minimum radius of curvature for the resilient member such that stresses within the resilient member are not substantially greater than a yield strength of the resilient member; and wherein the blocking member comprises an elastomeric strip mounted aside of the flexible region of the one of the mounting base, marker post and mounting bracket.

2. In a highway marker of the type having a mounting base, a marker post and a mounting bracket securing the marker post to the mounting base, one of the mounting base, the marker post and the mounting bracket being flexible for bending in a flexible region to rotate the marker post relative to the mounting base in response to forces acting on an outward end of the marker post, the improvement comprising:

a resilient member disposed proximate to the flexible region for bending with and stiffening the flexible region of the one of the mounting base, the marker post and the mounting bracket which is flexible and bends in response to the forces;

a blocking member extending on at least a rearward side of the resilient member for limiting a range of bending over which the resilient member bends with the flexible region of the one of the mounting base, the marker post and the mounting bracket;

wherein the blocking member limits the range of bending of the resilient member to determine a minimum radius of curvature for the resilient member such that stresses within the resilient member are not substantially greater than a yield strength of the resilient member;

wherein the mounting bracket is formed of two strips of elastomeric materials secured atop the mounting base and extending upwards with a gap therebetween for receiving an inward end of the marker post;

wherein the two strips of elastomeric materials are flexible for bending and providing the flexible region; and wherein the blocking member is a mass of elastomeric materials disposed between the two strips of elastomeric materials.

3. A highway marker, comprising in combination:

a mounting base;

a marker post having an outward end and an inward end, the inward end being flexible for bending in response to forces acting on the outward end;

mounting means for securing the inward end of the marker post to the mounting base;

a resilient member disposed proximate to the inward end of the marker post for bending with and stiffening the inward end of the marker post;

blocking means extending forward and rearward of the resilient member and the inward end of the marker post for limiting a range of bending over which resilient member and the inward end of the marker post bends in response to the forces acting on the outward end such that stresses within the resilient member are not substantially greater than a yield strength of the resilient member; and wherein the blocking means comprises two elastomeric strips, one mounted forward of and the other mounted rearward of the inward end of the marker post.

4. The highway marker according to claim 3, wherein the two elastomeric strips together comprise:

two strips of elastomeric belting, one mounted forward of and the other mounted rearward of the inward end of the marker post, and both of the two strips extending upwards toward and engaging the outer end of the marker post.

5. A highway marker, comprising in combination:

a mounting base;

a marker post having an outward end and an inward end, the inward end being flexible for bending in response to forces acting on the outward end;

mounting means for securing the inward end of the marker post to the mounting base;

a resilient member disposed proximate to the inward end of the marker post for bending with and stiffening the inward end of the marker post;

blocking means extending forward and rearward of the resilient member and the inward end of the marker post for limiting a range of bending over which resilient member and the inward end of the marker post bends in response to the forces acting on the outward end such that stresses within the resilient member are not substantially greater than a yield strength of the resilient member;

wherein the mounting means comprises a bracket having two ears which extend in an outward direction, parallel to the longitudinal axis of the marker post, each of the ears having a through hole for passing a bolt and being spaced apart for receiving the inner end of the marker post therebetween; and a bolt for extending through the holes in each of the ears and through the marker post to secure the marker post to the mounting base.

6. The highway marker according to claim 5, wherein the bracket and two ears are disposed within the mounting base.

7. In a highway marker of the type having a marker post and a mounting base, the marker post having an upper end and a lower end, with the lower end of the marker post being secured to the mounting base, the improvement comprising in combination:

two resilient strips secured to the mounting base, forward and rearward of the marker post, the two resilient strips disposed to extend upward from the mounting base and define two spaced apart mounting ears, with the lower end of the marker post disposed between the two spaced apart mounting ears;

mounting means securing the lower end of the marker post to the two spaced apart mounting ears; and pliant filler means extending between the two resilient strips and providing a resilient mass which, together with the two spaced apart ears of the two resilient strips, bends in response to forces acting on the marker post and urges the marker post to an upright, vertical position when the forces are released from the marker post.

8. The highway marker according to claim 7, wherein the two resilient strips are formed of two strips of elastomeric materials.

9. The highway marker according to claim 8, wherein the pliant filler means comprises a plurality of bonded crumb rubber pieces.

10. A method for marking a roadway with a highway marker of the type having a mounting base, a marker post and a mounting bracket for securing the marker post to the mounting base, the method comprising the steps of:

providing a mounting base, a marker post which is flexible in at least a lower end, a resilient member, a mounting bracket and two blocking members;

securing the mounting bracket to the lower end of the marker post, with the resilient member disposed proximate to the inward end of the marker post for bending with and stiffening the lower end of the marker post;

assembling the mounting bracket to the mounting base;

securing the blocking members to the mounting base, one forward of and another rearward of the lower end of the marker post;

wherein the blocking members are disposed such that impacting a forward end of the marker post pushes the marker post rearward against a rearward one of the blocking members, which then limits the range of bending of the lower end of the marker post to determine a minimum radius of curvature for the resilient member such that stresses within the resilient member are not substantially greater than a yield strength of the resilient member;

placing the mounting base proximate to a roadway, with the marker post extending from the mounting base and facing forward toward traffic; and wherein the step of providing further includes forming the marker post of elastomeric materials, wherein the resilient member is steel belting disposed within the elastomeric materials.

11. A method for marking a roadway with a highway marker of the type having a mounting base, a marker post and a mounting bracket for securing the marker post to the mounting base, the method comprising the steps of:

providing a mounting base, a marker post which is flexible in at least a lower end, a resilient member, a mounting bracket and two blocking members;

securing the mounting bracket to the lower end of the marker post, with the resilient member disposed proximate to the inward end of the marker post for bending with and stiffening the lower end of the marker post;

assembling the mounting bracket to the mounting base;

securing the blocking members to the mounting base, one forward of and another rearward of the lower end of the marker post;

wherein the blocking members are disposed such that impacting a forward end of the marker post pushes the marker post rearward against a rearward one of the blocking members, which then limits the range of bending of the lower end of the marker post to determine a minimum radius of curvature for the resilient member such that stresses within the resilient member are not substantially greater than a yield strength of the resilient member;

placing the mounting base proximate to a roadway, with the marker post extending from the mounting base and facing forward toward traffic;

providing two side members having brackets for mounting to the sides of the mounting platform, with the two side members extending downward from the mounting platform;

securing the side members to opposite sides of the mounting platform, each of the side members extending downward from the mounting base at an angle for fitting flush against opposite sides of a concrete highway median; and placing the mounting base atop the concrete highway median, with the marker post extending upwards from the mounting base, and the side members fitting flush against the opposite sides of the concrete highway median.

* * * * *